United States Patent [19]

Burey et al.

[11] Patent Number: 5,025,528

[45] Date of Patent: Jun. 25, 1991

[54] MULTIPLE STATION MACHINE FOR BRUSHING OR CLEANING FOOTWEAR

[76] Inventors: Bernard P. Burey, Route de Bonnetable, 72460 Savigne l'Eveque; Jean-Paul Barcon, ABC Material, la Lande de Vihiers St. Jean de la Motte, 72510 Mansigne, both of France

[21] Appl. No.: 258,270

[22] Filed: Sep. 26, 1988

[30] Foreign Application Priority Data

Nov. 24, 1986 [FR] France ..... 86 16589

[51] Int. Cl.[5] ..... A47L 23/02; A47L 23/20

[52] U.S. Cl. ..... 15/302; 15/34

[58] Field of Search ..... 15/302, 303, 310, 320, 15/34, 36, 180–182

[56] References Cited

U.S. PATENT DOCUMENTS

| | | | |
|---|---|---|---|
| 1,019,672 | 3/1912 | Lineback | 15/34 |
| 1,335,388 | 3/1920 | Raginia | 15/36 |
| 1,460,883 | 7/1923 | Bougher | 15/180 |
| 1,546,236 | 7/1925 | Haywood | 15/34 |
| 2,645,802 | 7/1953 | Mundo | 15/181 |
| 2,934,775 | 5/1960 | Bergstrom | 15/180 |
| 3,186,019 | 6/1965 | Hattori | 15/182 |
| 3,237,233 | 3/1966 | Adams | 15/182 |
| 3,312,994 | 4/1967 | Fissio | 15/180 |
| 3,737,942 | 6/1973 | Casey | 15/36 |
| 3,787,918 | 1/1974 | Ebert | 15/34 |
| 3,831,217 | 8/1974 | Odawra . | |
| 3,849,822 | 11/1974 | Ouellette | 15/36 |
| 4,024,599 | 5/1977 | Gamboa | 15/34 |

FOREIGN PATENT DOCUMENTS

| | | | |
|---|---|---|---|
| 1628487 | 12/1970 | Fed. Rep. of Germany | 15/34 |
| 1628669 | 4/1971 | Fed. Rep. of Germany . | |
| 2645093 | 4/1978 | Fed. Rep. of Germany | 15/36 |
| 1003144 | 11/1951 | France | 15/34 |
| 2535193 | 4/1984 | France . | |
| 2567013 | 1/1986 | France . | |
| 163235 | 10/1933 | Switzerland | 15/36 |
| 444401 | 2/1968 | Switzerland | 15/34 |
| 3871 | of 1890 | United Kingdom | 15/36 |

*Primary Examiner*—Harvey C. Hornsby
*Assistant Examiner*—Scott J. Haughland
*Attorney, Agent, or Firm*—Sandler, Greenblum & Bernstein

[57] ABSTRACT

An apparatus for brushing and/or cleaning shoes and other footwear which includes a number of sequential stations. The apparatus includes a machine having a plurality of upstanding brushes mounted for rotation about respective generally vertical axes. The vertical axes of the upstanding brushes are sequentially spaced apart and each of the brushing stations is defined by a sequential pair of the upstanding brushes. Between sequential pairs of the upstanding brushes, a respective flat circular brush is mounted. Each of the brushes is driven by a single motor. Further, a casing is provided for housing the brushes and at least a portion of the driving transmission from the motor. The casing has a lateral opening at each of the brushing stations for introducing a shoe or boot for brushing or cleaning. A cleaning fluid for the brushing and/or cleaning stations can be merely water or water with an additive such as a detergent or disinfectant. In addition, heated air can be provided for drying the cleaned shoes.

27 Claims, 3 Drawing Sheets

MULTIPLE STATION MACHINE FOR BRUSHING OR CLEANING FOOTWEAR

Figure 1:
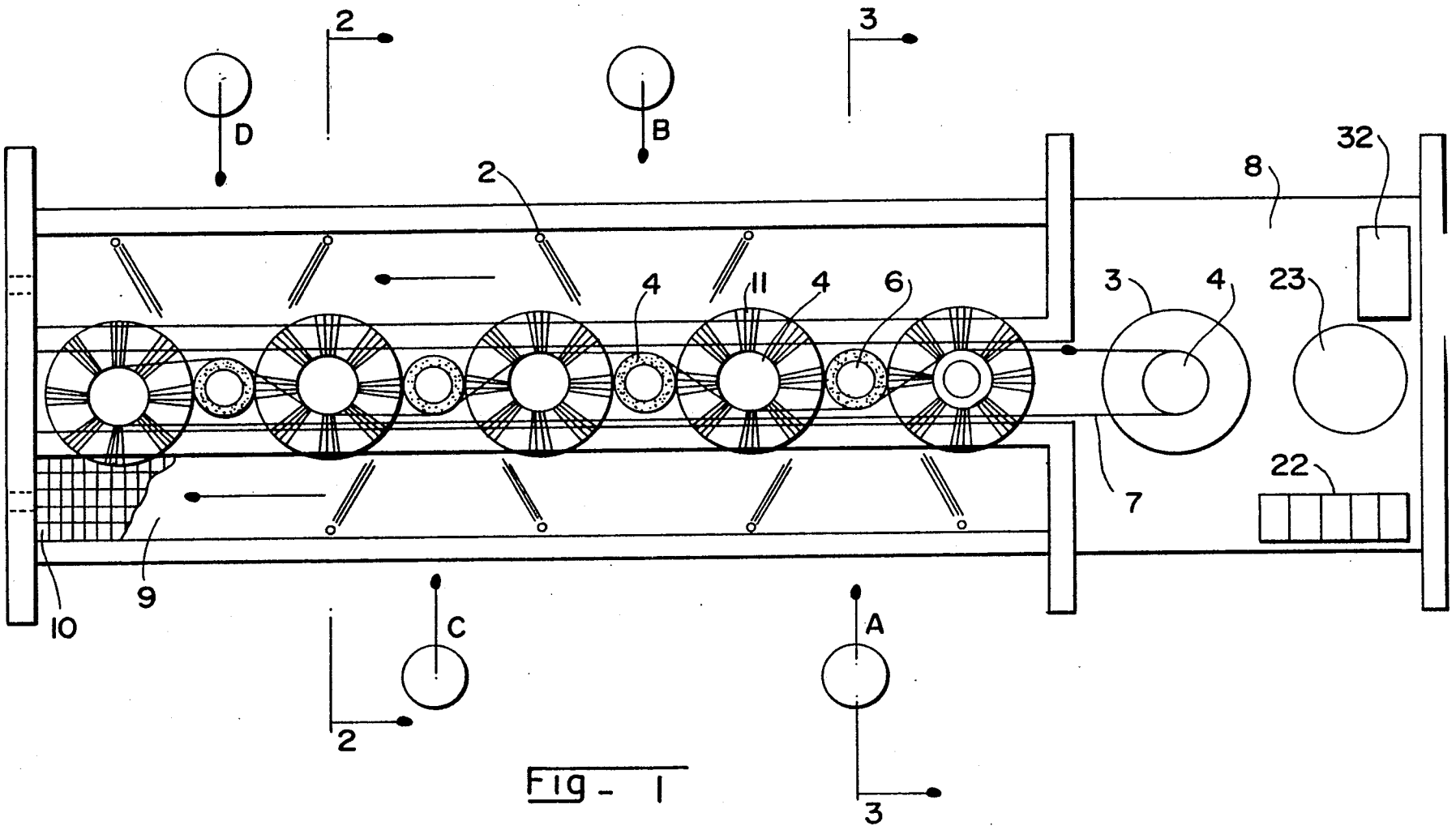

The present invention relates to a multiple station machine for the dry brushing or the washing of boots, ankle-boots and various shoes, with splashing of pure water or of water added with a dressing, cleaning, disinfection, decontamination product, with a blowing of hot air.

This brushing and cleaning operation is indispensable in many fields. It is imposed by elementary hygiene measures and by the legislation and sanitary rules in force in the various corporations and countries interested. The fields of application are varied: agro-alimentary, building, earthwork, public works, drilling, nuclear, winter sports and similar.

This brushing and cleaning operation is carried out in almost the totality of cases manually or sometimes, in slaughter houses or salting installations, with the assistance of individual machines such as disclosed in patent No. FR 2 535 193 the object of which was the cleaning of boots on a single station, with the assistance of brushes of a non settable height and not including a mechanized brushing system of the soles.

However, a profitability and cost problem exists when one has to meet the needs of the industries or communities employing a large labor force and being confronted with the dry cleaning of shoes or the brushing of a large number of boots, ankle-boots, laced boots, within a few minutes, when the personnel is leaving. Moreover, it is necessary to control in a rigorous manner the flow rates of water with detergents or any other additives, to reduce the maintenance costs by a great sturdiness and simplicity, to increase the efficiency of the epuipment and their adaptation to the environment for example, by a rapid setting of the height of the brushes, the replacement of the latter, a total acces to all the corners, spots of development of bacteria and finally improving the cleaning quality.

This invention is composed of a very compact machine, with multiple in-line vertical brushes (11), with an access to the various stations A, B, C, D situated on either side of the machine. The number of in-line stations is from two to a number the only limit of which is the space requirement of the machine and the technical constraints of the driving materials. Each vertical brush (11) with the exception of the end brushes as regards machines in a straight line, is used simultaneously on two stations.

Another form of machine is possible, whereby the machine is in-line, with its back resting against the wall of a workshop outlet corridor for example. In this case, the access to the stations can only be performed from one side.

In all the other forms of machine which are possible: round, octogonal, in a closed-loop, for example, all the brushes are used simultaneously on two stations.

Centered between each of the vertical brushes is situated a brush with a vertical axis and of a smaller diameter (6) allowing the brushing of the soles. A non-skidding perforated metal sheet (10) or a grid according to the requirements or type of machine, removable, being formed with openings for the passage, covers this brush while letting it project through only over the portion which is useful for the brushing and allowing the operator to hold the shoe. Each vertical brush (11) is of a height adapted to the shoes by a stacking of elements of appropriate height, whereby the spacing of these same brushes can be different for a certain number of stations of the same machine, as a function of the percentage of persons: females or males, using the machine.

This brushing machine can be combined with other functions, viz. the washing with pure water or with water with various additives, detergents, desinfectants, decontaminants and also with a supply of hot air all of which can be appropriately projected from nozzles at the respective stations. This list is not limiting. This necessitates the installation of electrovalves and of accurate metering apparatus settable to 2, 3, 4, 5% of the motive fluid flow rate, of hot air turbines.

This machine is composed of a rigid frame on which are fixed all the constituent elements.

Figure 3:
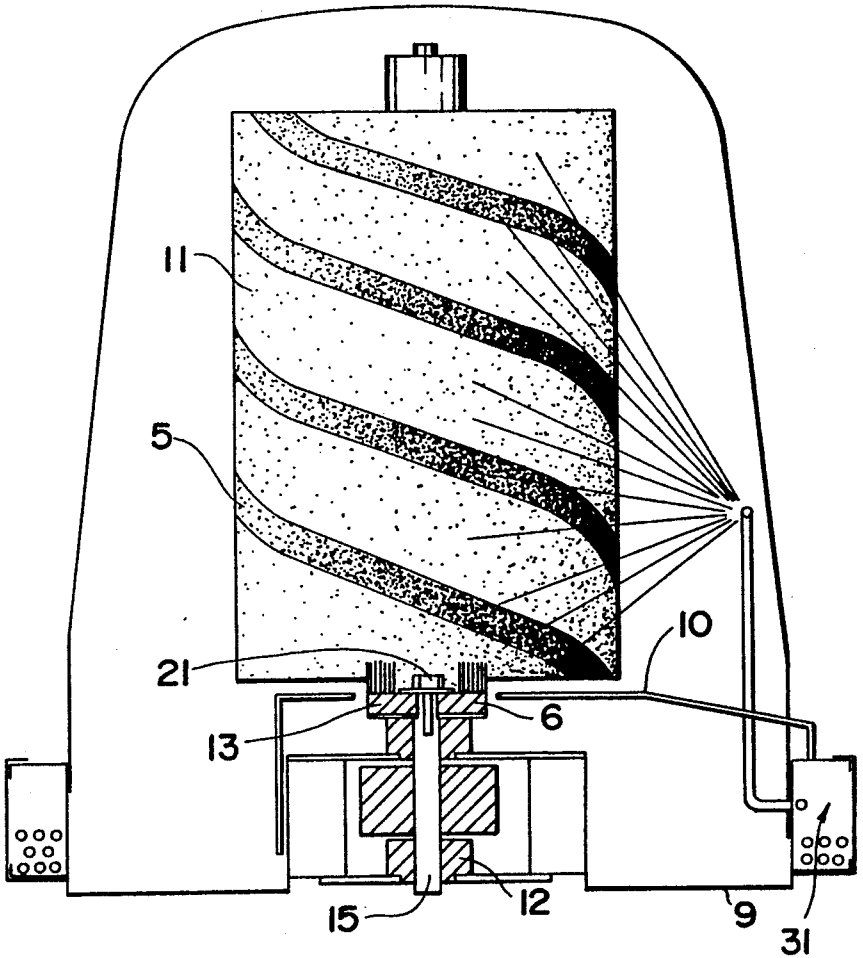
Figure 2:
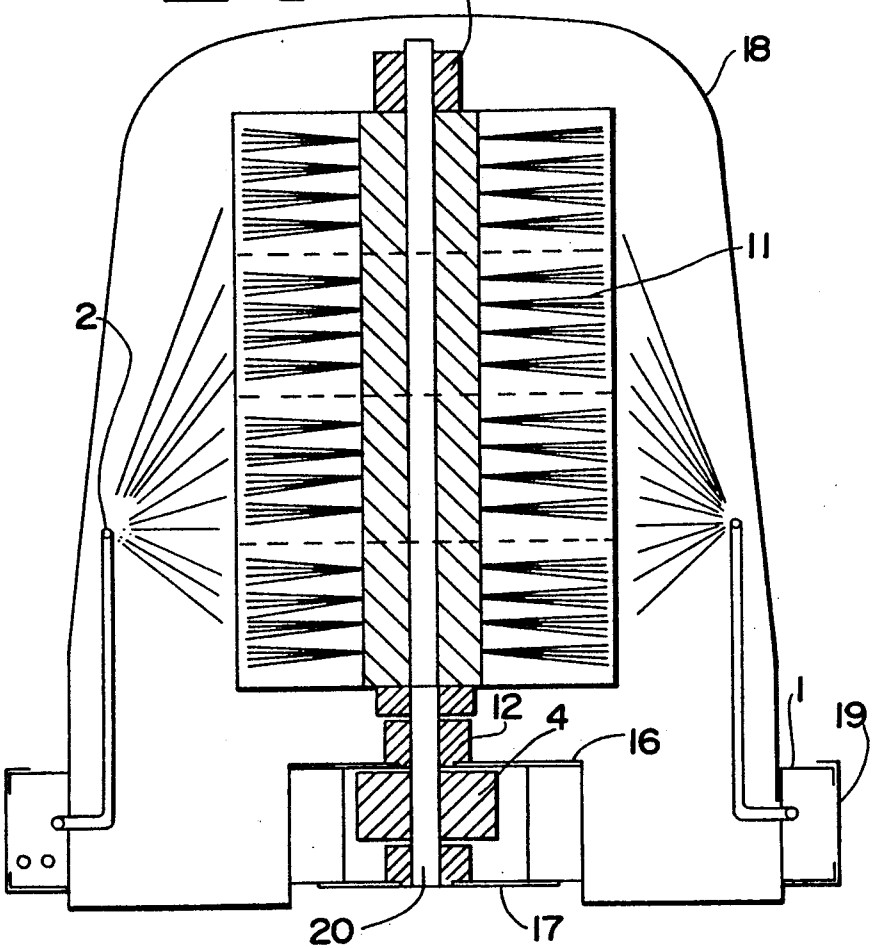
Figure 4:
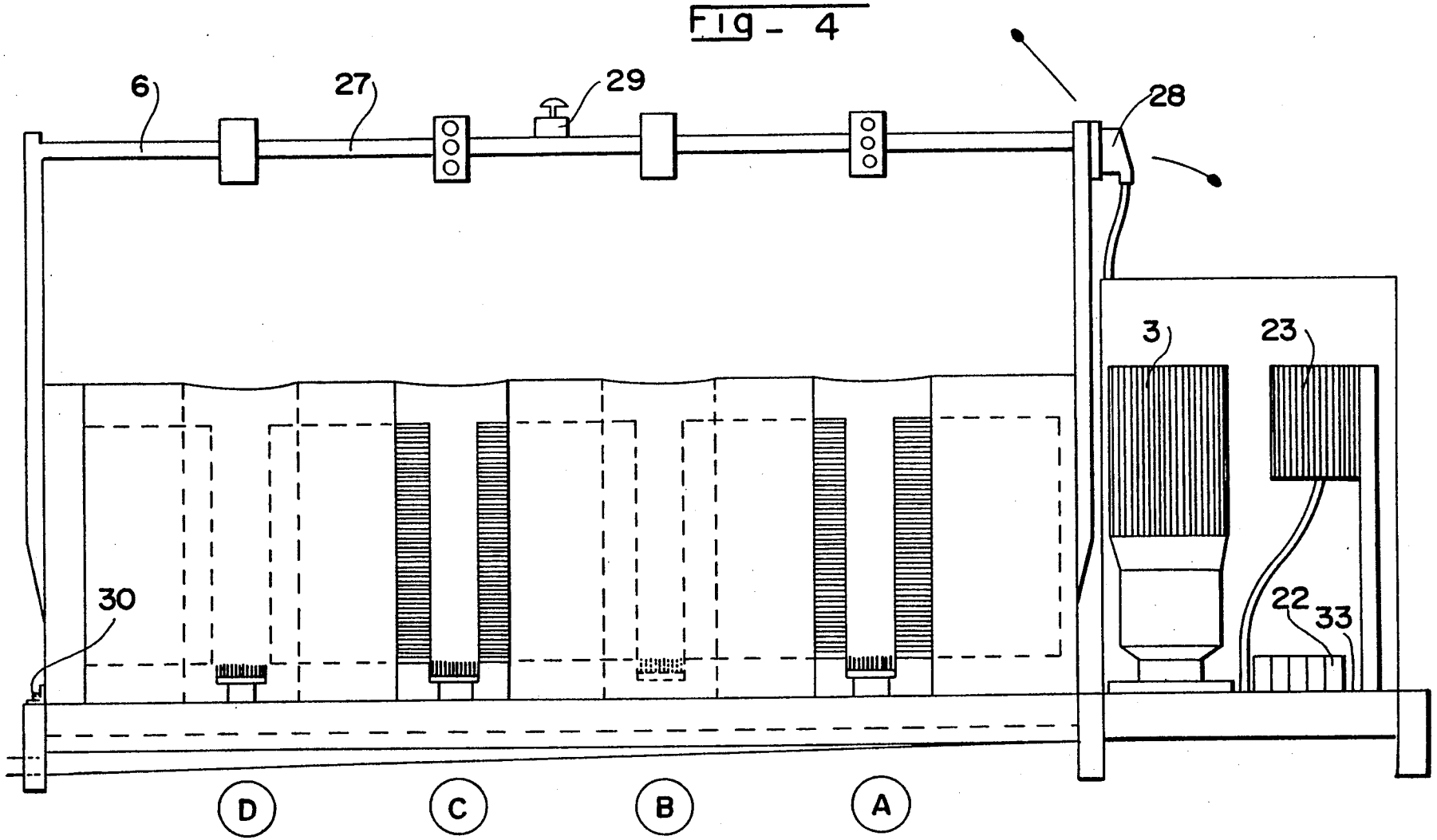

With reference to the accompanying drawings of an embodiment of a straight line compact machine with access from both sides which show respectively:

FIG. 1 a top view of the driving device and of the chassis,

FIG. 2 shows in a transverse sectional view along line 2—2 of FIG. 1 the mounting of the large brush, FIG. 3 shows in a transverse sectional view along line 3—3 of FIG. 1 the mounting of the small brush, FIG. 4 is a front view of a typical machine with 4 stations.

This invention is composed, more particularly in the lower portion, in the brushing and washing section, of a frame formed by four parallel girders of great rigidity. The two central girders form a caisson through the adjunction of an upper (6) and lower (17) metal sheet in which is situated the driving device (4) for the vertical axes of the brushes (15) and (20). On the upper portion of each of the metal sheets is fixed a bearing (12), allowing the rotation of the vertical axes of the shoe upper brushes (20) and of the soles brushes (15). According to a preferential embodiment, a pinion (4) which is rigidly connected to the shaft extending through these two bearings is driven by a flat belt (7), with teeth on both sides.

As a function of technical imperatives: large width, additives in the washing water or special products, or the shape of the machine, other driving types are necessary and possible.

According to a first variant, the driving can be carried out with the assistance of a chain.

According to a second variant, the driving of the pinions can be effected with the assistance of a train of pinions driving mutually each other.

The center of the first brush, in the case of a machine in a straight line, as well as the center of the motor, are offset with respect to the general axis of the centers of the brushes in order to permit the disengagement of the return strand of the belt or chain.

The rotation directions of the two vertical brushes (11) of the same station is in the reverse direction but the rotation direction has to be such that any projection of water or dirt can only occur toward the bottom of the station in consideration. Indeed, during the rubbing of the bristles of the brushes on the shoe, a pressure is exerted on these bristles, they curve themselves and when they are freed, they resume their initial shape and whip the air while projecting the drops of water and dirt, and it is therefore important to take this pecularity in account.

Between the central girders and the outer girders (1) are fixed liquid or solid materials recovery tanks (9)

having a slant toward one of the ends or toward both ends, in the case of a large length machine, in order to collect the liquids during the washing operations of the shoes or of the tanks.

The protection casing (18) for the brushes covers the totality of the rotating members. It is formed, in the compact alternated straight line machine version, on either side of its faces, with openings which are alternated and offset, and allow the passage of the leg. The openings are situated in the center of an assembly formed of two vertical brushes and of a flat brush. The casing is articulated (30) in the end opposite to the motor, so as to allow the complete tipping and therefore the total access to all the rotating members for maintenance purposes and an efficient and easy cleaning of the latter, of the parts forming the frame, of the recovery tanks (9).

In the models of machines having seven stations and more, or according to request, the casing (18) is composed of several sections which are removable by being lifted.

As regards the two outers girders (1), they are composed of "U"-bent metal sheets, with their opening toward the outside of the frame and closed by a nesting cover (19), thereby housing various ducts (31). For machines having washing, disinfection, decontamination means, the liquid ducts are extending inside this "U". For the machines equipped with drying means with hot air, the ducts are also inside. In the case of machines intended for the washing, disinfection, decontamination, the projection of liquid is effected on the front face of the vertical brushes, with the assistance of nozzles (2) fixed on the "U"-shaped girders on either side of each opening and inside the protection casing, the water sheet is projected toward the front, tangentially to the vertical brushes, thereby permitting reducing the consumption of water and of additives in an important manner. Indeed, in the case of a liquid projection on the rear face of the vertical brushes, due to the centrifugal force, the water is expelled during the rotation which it accomplishes prior to the addition of a solution on the boot, hence an exaggerated consumption of liquid and a longer time for the washing.

The vertical brushes (11) are composed of stackable elements, of different height allowing, if need be, adjusting with a high precision the brushing height to the real height of the boots, the latter being different when it is a woman's boot as compared to a man's boot. This machine permits having stations with different brush heights, the fixation being obtained by a ring provided with a clamping member (14) at the end of the vertical axis. Moreover, each element possesses a crown of hard bristles (5) of helical shape which, associated with the rotation direction of the brushes and with the right-hand pitch on one side, the left-hand pitch of the other of this helical crown, is such that the vertical brushes (11) are in their whole of a great efficiency and the dirt is projected by this Archimedes screw in the tanks (9).

The flat brushes are fixed on a vertical axis (15) tapped at its end. It is composed of a horizontal washer on which bears the brush. A centering pin (13) avoids the rotation of the brush, the clamping being obtained by a bolt (21) screwed in the axis (15).

The holding of the persons is ensured in a stable vertical position, by a holding railing (26) right above the brush casing (18) rigidly connected to the latter. It possesses, facing each access station to the brushes, a kind of console (27) with all the controls necessary for the setting in action of the members composing the machine: an on-off motor control, an electrovalve control, a control for the hot air turbine (32).

The safety of the persons is ensured at this level by one or several so-called "fist-hit" safety switches for stopping movement of the motor in an emergency, which are easily accessible access whatever the station in consideration (29).

The connection between the holding railing (26) and the electric cabinet is obtained by a multi-wire electric cable, the connection being interrupted when removing the casing by a water-tight multiple and removable socket (28) fixed at the end of said ramp.

As regards the accessory portions, the reduction gear unit (3), the electrovalves (22), the metering apparatus (23), the pressure reducer, the hot air turbine (32) of the machine in a straight line, they are positioned on a platform (33) at the end of the machine and are protected by a removable casing.

In the case of a long machine, a platform is provided at each end or at intervals, in the brushes line.

In the case of a closed-loop machine, all the accessories are situated in the center.

We claim:

1. A machine for brushing footwear which includes a plurality of brushing stations, said machine comprising:
   (a) a plurality of upstanding brushes mounted for rotation about respective generally vertical axes, said vertical axes being sequentially spaced apart, each of said brushing stations including a sequential pair of said upstanding brushes;
   (b) a flat circular brush mounted between respective ones of said sequential pairs of said upstanding brushes at each of said brushing stations;
   (c) a single motor;
   (d) means operatively connected to said single motor for rotatably driving each of said plurality of upstanding brushes and said flat circular brushes; and
   (e) a casing for housing said plurality of upstanding brushes and said flat circular brushes and at least a portion of said means for rotatably driving each of said plurality of upstanding brushes and said flat circular brushes, said casing having a lateral opening at each of said brushing stations for introducing an item of footwear into said respective brushing stations.

2. The machine of claim 1, wherein said means for rotatably driving said brushes comprise means for driving said plurality of upstanding brushes in opposite rotational directions, sequentially.

3. The machine of claim 1, wherein at least each of said plurality of upstanding brushes is comprised of a plurality of elements which are vertically stackable, thereby permitting said upstanding brushes to be selectively variable in height.

4. The machine of claim 3, wherein each of said elements of said plurality of upstanding brushes comprises a helical band of generally hard bristles of alternating pitch, respectively.

5. The machine of claim 1, further comprising a frame upon which said brushes are mounted, wherein said machine further comprises means for permitting said casing to be removably mounted with respect to said frame.

6. The machine of claim 5, wherein said means for permitting said casing to be removably mounted with respect to said frame comprises means for pivotably mount said casing with respect to said frame.

7. The machine of claim 1, wherein said motor is electric.

8. The machine of claim 1, wherein said motor is pneumatic.

9. The machine of claim 1, wherein said drive transmitting means comprises a pinion operatively connected to each of said brushes and a drive belt operatively connected to said motor for being driven by said motor and operatively connected to each of said pinions for driving said pinions.

10. The machine of claim 9, wherein said pinions are mounted coaxially to respective ones of said brushes for transmitting rotary motion to said pinions.

11. The machine of claim 10, wherein said drive belt has teeth on each of two sides of said drive belt for engagement with complementary teeth on said pinions.

12. The machine of claim 10, wherein said pinions and said drive belt are positioned below said brushes.

13. The machine of claim 1, further comprising a holding rail adjacent each of said brushing stations adapted for holding by a user of said machine.

14. The machine of claim 13, further comprising a control console mounted proximate said holding rail for at least controlling said motor and including at least one emergency stopping switch.

15. The machine of claim 13, further comprising a power cable for said motor including a removably connectable plug positioned proximate said holding rail for disconnecting said power from said motor.

16. The machine of claim 1, further comprising means for conducting cleaning fluid to each of said brushing stations.

17. The machine of claim 16, wherein said cleaning fluid comprises water.

18. The machine of claim 16, wherein said cleaning fluid comprises water with an additive, said additive selected from the group consisting of a detergent, a disinfectant, and a decontaminant.

19. The machine of claim 16, further comprising a supporting framework comprised of a plurality of girders, at least one of said girders comprising a housing for said means for conducting cleaning fluid.

20. The machine of claim 19, further comprising means for conducting heated air for drying said footwear and wherein said at least one of said girders comprises a housing for said means for conducting heated air for drying said footwear.

21. The machine of claim 16, further comprising a recovery tank below said brushing stations for receiving said cleaning fluid and an outflow connected to said recovery tank.

22. The machine of claim 16, wherein each said upstanding brushes comprises a helical band of generally hard bristles of alternating pitch, respectively, wherein said means for rotatably driving said brushes comprise means for driving said upstanding brushes in opposite rotational directions, sequentially, for projecting said cleaning liquid downwardly.

23. The machine of claim 1, further comprising means for conducting heated air for drying said footwear.

24. The machine of claim 1, further comprising, below said brushes, a non-skid perforated support surface.

25. A machine for brushing footwear which includes a plurality of brushing stations, each of said stations being adapted to brush an item of footwear, said machine comprising:

(a) at least a first brush, a second brush, and a third brush, each of said brushes being rotatably mounted around a respective generally vertical axis and having a certain height, said brushes comprising at least two of said plurality of brushing stations, whereby said item of footwear is selectively insertable between said first brush and said second brush, at a first brushing station, or between said second brush and said third brush, at a second brushing station, for brushing at least an upper portion of said item of footwear;

(b) a first sole brush positioned between said first brush and said second brush and a second sole brush positioned between said second brush and said third brush, each of said first sole brush and said second sole brush having a height substantially less than that of said first brush, said second brush, and said third brush, whereby said first brush, said second brush, and said third brush project upwardly beyond said first sole brush and said second sole brush;

(c) means for rotatably driving said first brush, said second brush, said third brush, said first sole brush, and said second sole brush, comprising a single drive motor and means for transmitting driving force from said single drive motor to said first brush, said second brush, said third brush, said first sole brush, and said second sole brush.

26. The machine of claim 25, wherein said first sole brush and said second sole brush each have upstanding bristles, creating a generally flat upper surface.

27. The machine of claim 25, wherein said means for rotatably driving said first brush, said second brush, said third brush, said first sole brush, and said second sole brush comprise means for driving said first brush, said second brush, and said third brush in opposite rotational directions, sequentially.

* * * * *